US007824095B2

(12) United States Patent
Danielsson et al.

(10) Patent No.: US 7,824,095 B2
(45) Date of Patent: Nov. 2, 2010

(54) PACKAGE FOR FIBRES AND A METHOD FOR THE APPLICATION THEREOF

(75) Inventors: Ralf Danielsson, Hollviken (SE); Rikard Engblom, Simlangsdalen (SE)

(73) Assignee: Confib AB, Vellinge (SE)

( * ) Notice: Subject to any disclaimer, the term of this patent is extended or adjusted under 35 U.S.C. 154(b) by 562 days.

(21) Appl. No.: 11/719,873

(22) PCT Filed: May 17, 2005

(86) PCT No.: PCT/SE2005/000705

§ 371 (c)(1),
(2), (4) Date: Aug. 15, 2007

(87) PCT Pub. No.: WO2006/054929

PCT Pub. Date: May 26, 2006

(65) Prior Publication Data

US 2009/0148632 A1 Jun. 11, 2009

(30) Foreign Application Priority Data

Nov. 22, 2004 (SE) ..... 0402848

(51) Int. Cl.
*B26D 7/06* (2006.01)
*B28C 7/04* (2006.01)

(52) U.S. Cl. ..... 366/2; 366/8; 366/16; 366/153.3

(58) Field of Classification Search ..... 366/2, 366/8, 16, 153.3
See application file for complete search history.

(56) References Cited

U.S. PATENT DOCUMENTS 3,199,671 A * 8/1965 Davy ..... 206/503
4,023,706 A * 5/1977 Dearlove et al. ..... 222/1
4,289,438 A * 9/1981 Murer ..... 414/412
4,630,311 A * 12/1986 Bentson ..... 383/37
4,725,184 A * 2/1988 Bennison ..... 414/412
4,844,313 A * 7/1989 Yamamoto ..... 226/83
4,946,339 A * 8/1990 Berg et al. ..... 414/811
4,993,550 A * 2/1991 Mercer et al. ..... 206/321

(Continued)

FOREIGN PATENT DOCUMENTS

DE 2107851 8/1972

(Continued)

OTHER PUBLICATIONS

F.M.Rabinovich; "Dispersing Fiber Reinforced Concretes", Moscow, 1976, pp. 22-23.

*Primary Examiner*—Tony G Soohoo
(74) *Attorney, Agent, or Firm*—Ladas & Parry LLP

(57) ABSTRACT

A package for reinforcing fibers to be used in production of fiber concrete or similar materials. The package has a continuous, elongated design with a circular, elliptical, square, rectangular or polygonal cross section. The fibers are longitudinally or transversally or randomly oriented and are filled into the package, wherein the fibers are uniformly arranged so that each length unit of the package has a defined amount of fibers. The continuous package is arranged into a transport box to be delivered to a concrete plant. The continuous package is fed to a conveyer belt, an aggregate belt, a skip, a weigh hopper, a truckmixer, or a premixer, wherein the package is opened and the fibers are dosed into the concrete.

9 Claims, 15 Drawing Sheets

U.S. PATENT DOCUMENTS

| | | | | |
|---|---|---|---|---|
| 5,030,314 | A * | 7/1991 | Lang | 156/390 |
| 5,224,774 | A | 7/1993 | Valle et al. | |
| 5,706,635 | A * | 1/1998 | Simmons | 53/511 |
| 5,897,928 | A * | 4/1999 | Sanders et al. | 428/36.92 |
| 5,985,449 | A * | 11/1999 | Dill | 428/399 |
| 6,256,969 | B1 | 7/2001 | Fragstein | |
| 6,550,362 | B1 * | 4/2003 | Galinat et al. | 83/23 |
| 2009/0148632 | A1 * | 6/2009 | Danielsson et al. | 428/34.1 |

FOREIGN PATENT DOCUMENTS

| | | | |
|---|---|---|---|
| DE | 7702730.6 | | 1/1977 |
| FR | 2866264 | | 8/2005 |
| GB | 786188 | | 11/1957 |
| JP | 2001219905 | | 8/2001 |
| RU | 2 202 473 | C2 | 4/2003 |
| SU | 910495 | A1 | 3/1982 |
| WO | WO95/12528 | | 5/1995 |
| WO | WO02/090074 | | 11/2002 |

* cited by examiner

FIG 3B
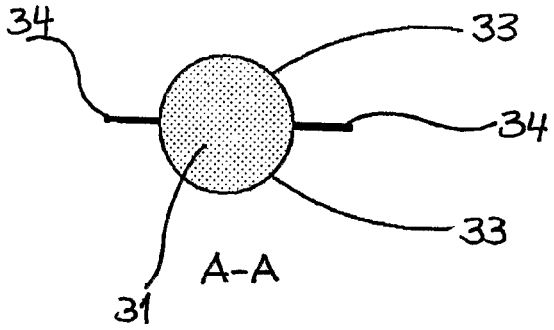
FIG 3A
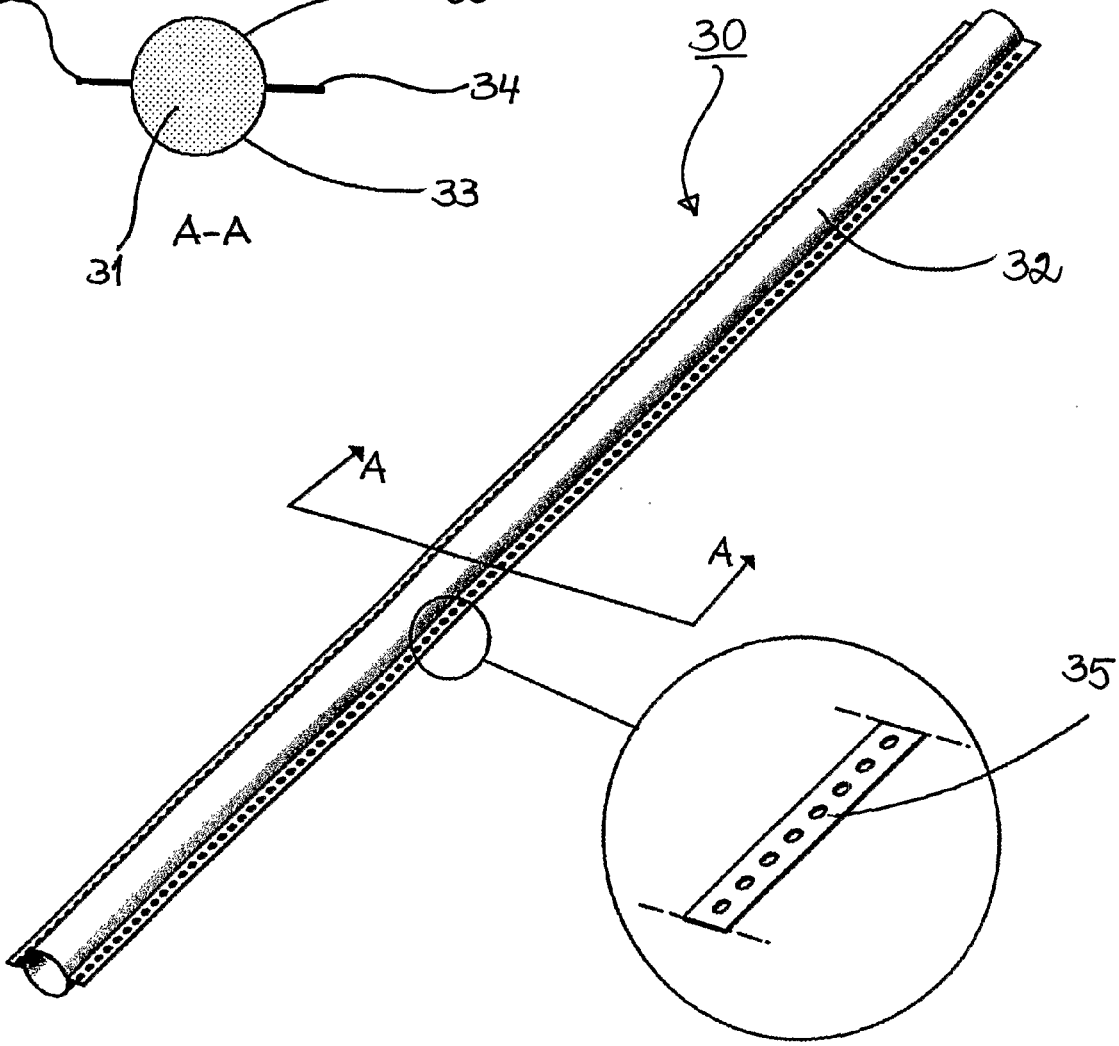
FIG 3C

FIG 4B
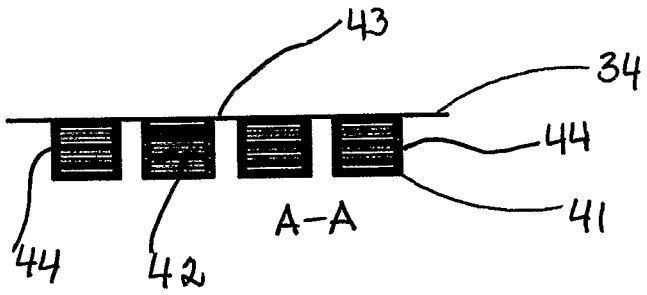
FIG 4A
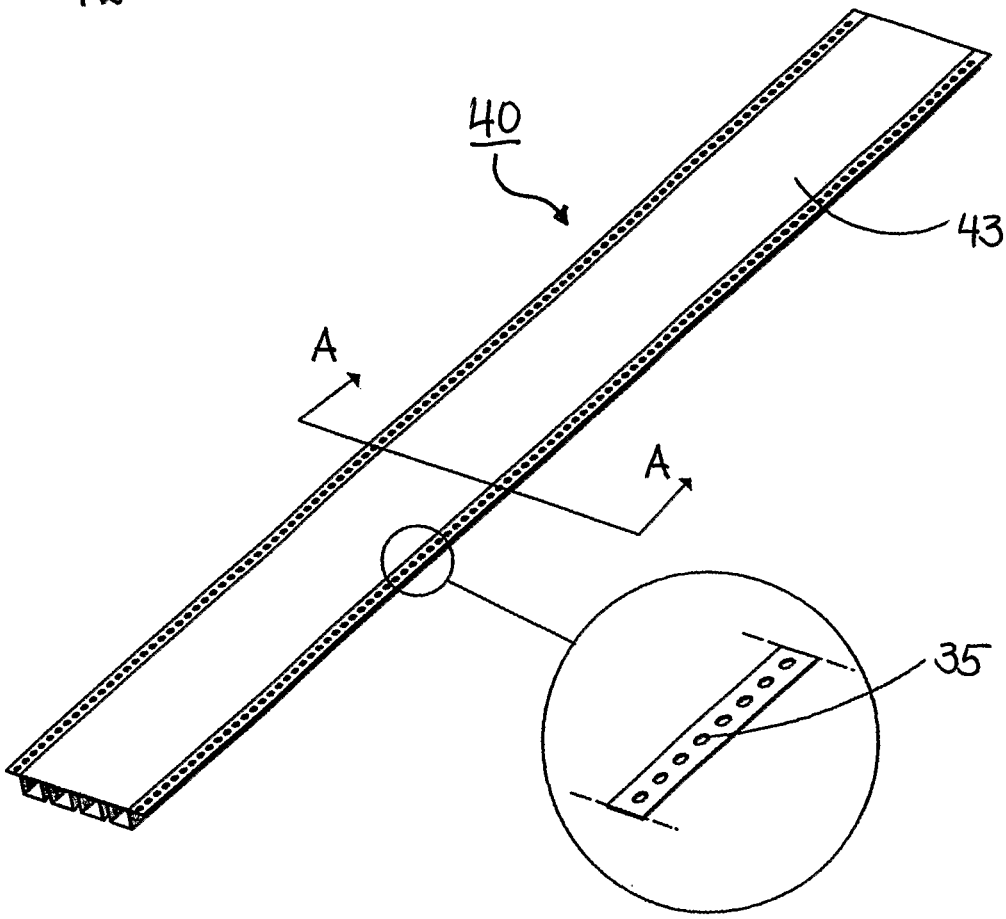
FIG 4C

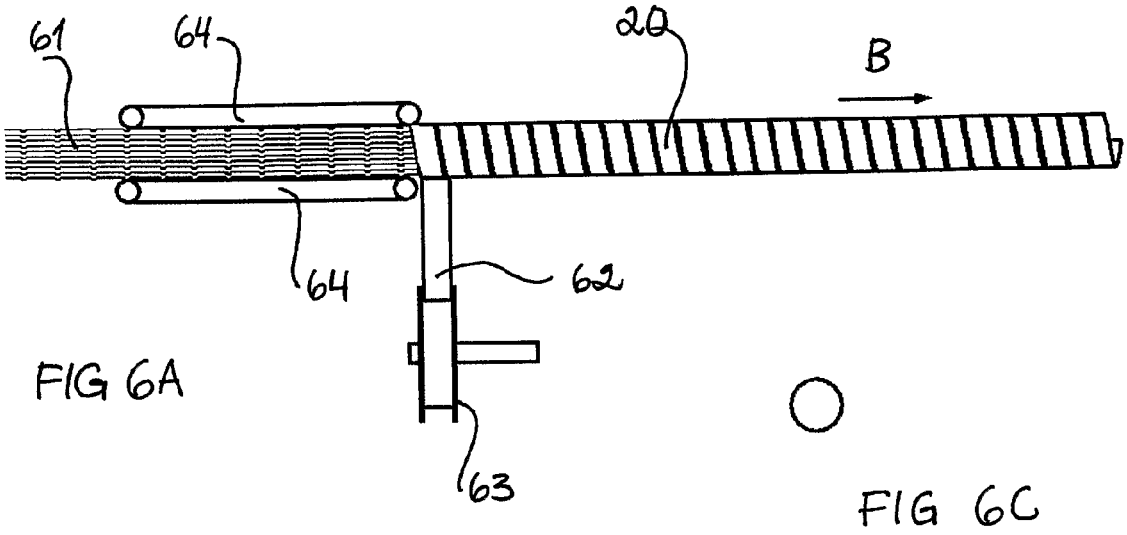
61
64
20
B
64
62
63
FIG 6A
FIG 6C
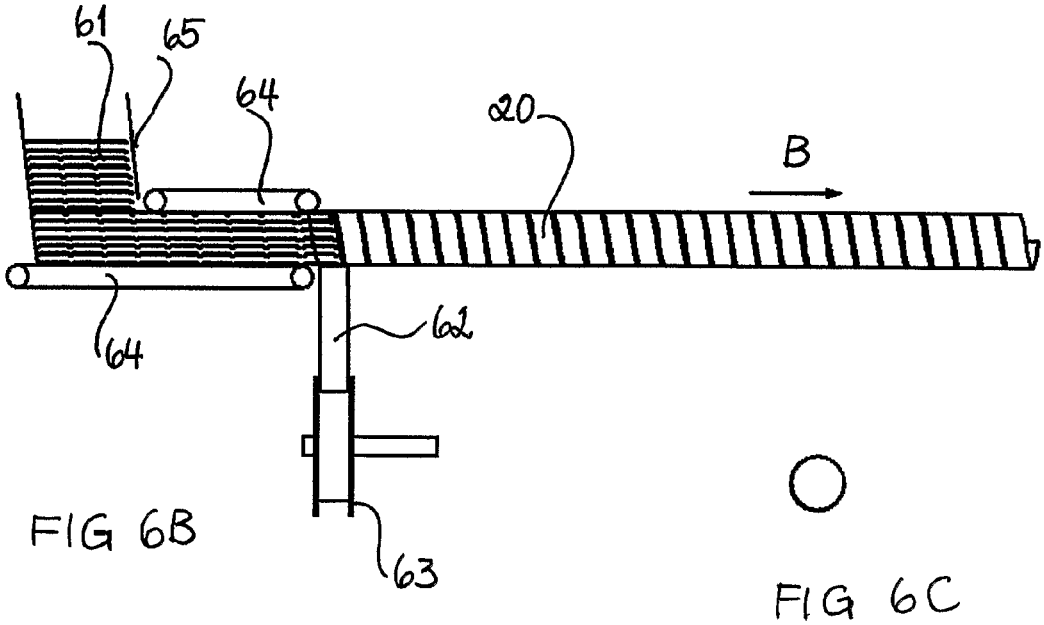
61
65
64
20
B
64
62
63
FIG 6B
FIG 6C

PACKAGE FOR FIBRES AND A METHOD FOR THE APPLICATION THEREOF

FIELD OF THE INVENTION

The invention relates to a package for fibres for reinforcement of materials, such as concrete, and to a method for filling and dosing reinforcing fibres into the material during production of for example fibre concrete or similar materials.

BACKGROUND OF THE INVENTION

For the production of fibre concrete or a material reinforced with reinforcing fibres, it is important to supply the desired amount of reinforcing fibres to the mixture of components of concrete, mortar or similar materials. The different components of the concrete may be stored separately. When it is time for manufacturing the concrete, the required quantities of each component are supplied to concrete mixers or silos.

The supply of the exact amount of reinforcing fibres may be difficult, and complicated dosing or weighing machines are previously used. Another problem is that the dosing and weighing of reinforcing fibres are time-consuming and troublesome, especially, when the dosing is performed at the building yard.

WO 02/090074 describes a method for dosing reinforcing fibres for the manufacturing of fibre concrete, wherein a chain package is used. The chain package comprises a number of sacks with reinforcing fibres, which are joined together like a chain.

SUMMARY OF THE INVENTION

An object of the present invention is to eliminate the drawbacks mentioned above, which is achieved by assigning to the package the characteristics according to claim 1.

A further object of the invention is to provide a method for filling and dosing reinforcing fibres into concrete or similar materials.

A yet further object of the invention is to apply the package and the method in a system, wherein a very practical and accurate dosing of reinforcing fibres into concrete is achieved.

According to one aspect of the invention, a continuous package for reinforcing fibres is provided.

According to another aspect of the invention, a method for filling and dosing fibres into concrete is provided, wherein the method comprises providing a continuous package and continuously filling the package with fibres by means of a filling machine.

According to yet another aspect, a system is provided, wherein the continuous package and the method for filling and dosing fibres into concrete are applied.

Other objects, features and advantages of the present invention will appear from the following detailed description, from the attached drawings as well as from the dependent claims.

BRIEF DESCRIPTION OF THE DRAWINGS

In order to explain the invention, a number of embodiments of the invention will be described below with reference to the drawings, in which;

FIG. 3A is a schematic perspective view showing a package according to a second embodiment of the invention, FIG. 3B is a cross sectional view of the package in FIG. 3 filled with fibres, FIG. 3C is an enlarged view of the circled area in FIG. 3A, FIG. 4A is a schematic perspective view showing a package according to a third embodiment of the invention, FIG. 4B is a cross sectional view of the package in FIG. 4A filled with fibres, FIG. 4C is an enlarged view of the circled area in FIG. 4A, FIG. 6C is a cross sectional view of the packages in FIGS. 6A and 6B.

Same reference numerals have been used to indicate the same parts in the figures to increase the readability of the specification and for the sake of clarity.

DESCRIPTION OF EMBODIMENTS OF THE INVENTION

Figure 1:
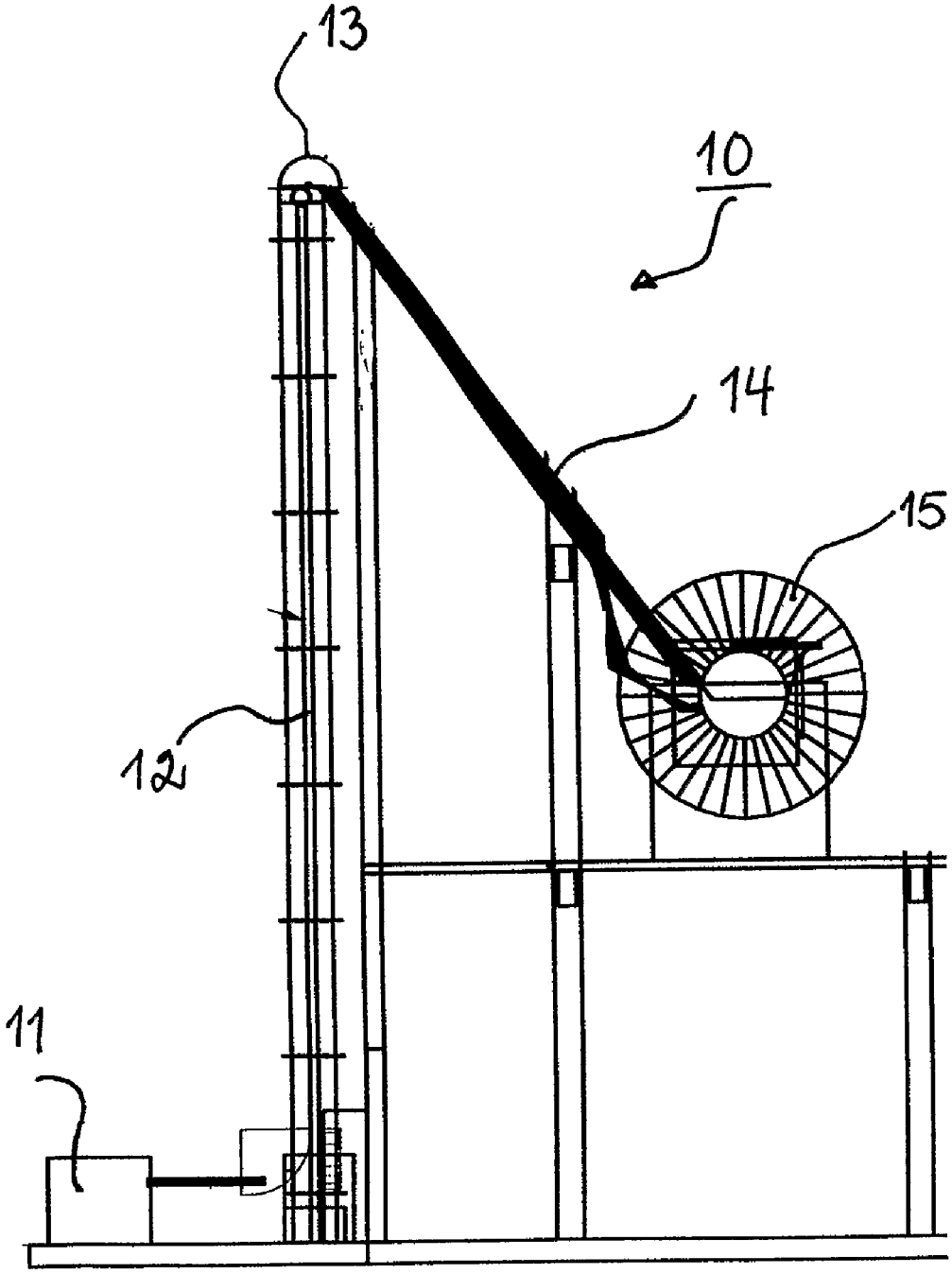
FIG. 1 is a schematic side view of a system, wherein the method of filling and dosing fibres into concrete according to the invention is applied.

FIG. 1 discloses a system 10 and a method for filling and dosing fibres into concrete. The method will be explained below. The system 10 comprises a continuous package 20, 30, 40, 50 which is filled with fibres and which is arranged in a transport box 11, feeding means 12 for feeding the continuous package 20, 30, 40, 50, to a high position 13, where the package 20, 30, 40, 50 is opened by not shown opening means. The fibres in the package 20, 30, 40, 50 will then fall down through a groove 14 to be added to the concrete on a aggregate belt, on a weight belt, in a truckmixer, in a skip or in a premixer 15. The system may further comprise additional feeding means 12 for feeding the continuous package 20, 30, 40, 50 into the transport box 11, after the filling of the fibres, and rolls for winding the package material when the package has been opened.

Figures 2A, 2B:
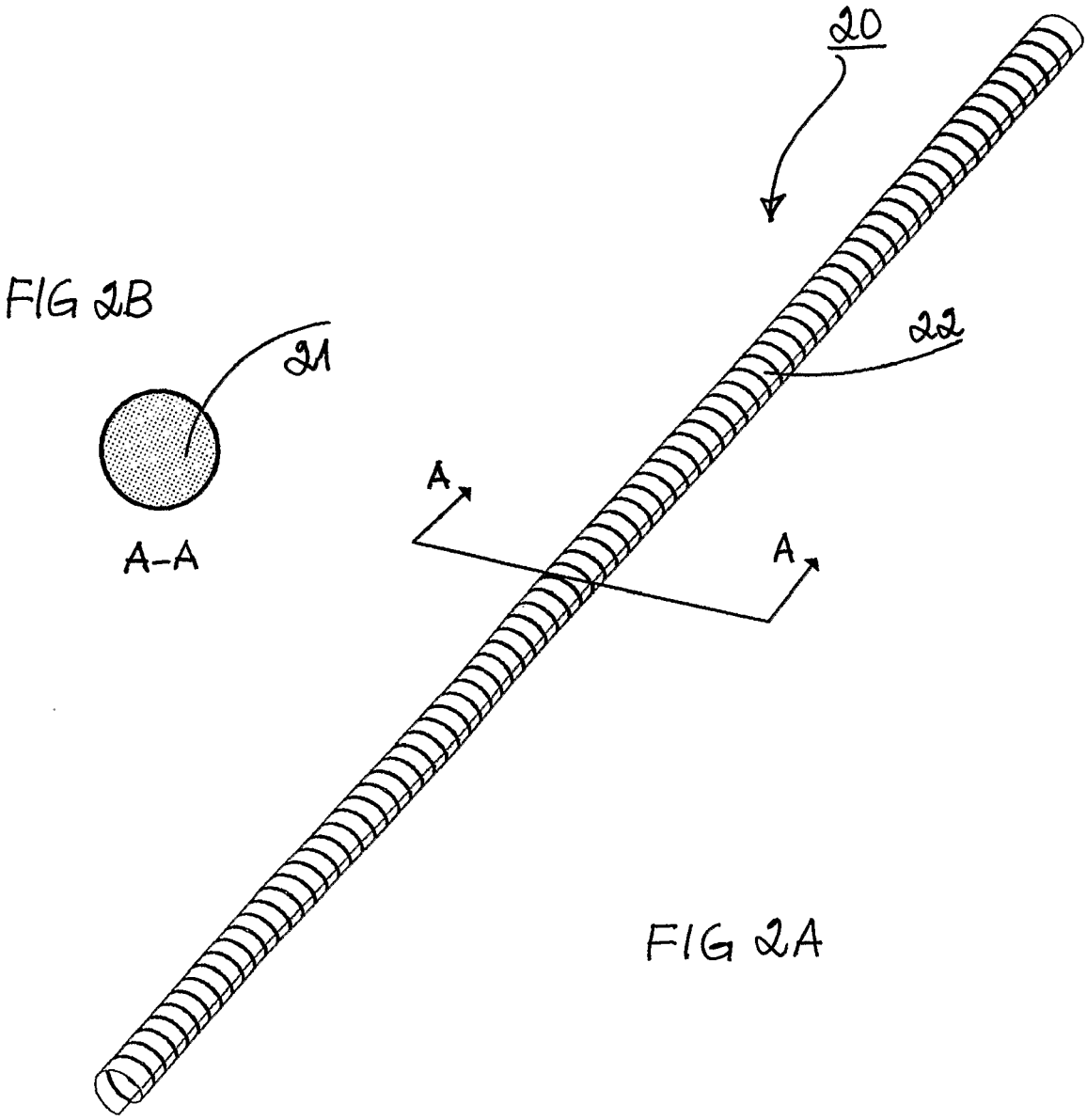
FIG. 2A is a schematic perspective view showing a package according to a first embodiment of the invention.
FIG. 2B is a cross sectional view of the package in FIG. 2A filled with fibres.

A first embodiment of the package 20 is described with reference to FIGS. 2A and 2B, in which the package 20 having a circular cross section 21 is shown. The package 20 is tubular forming a longitudinal cavity surrounded by an exterior wall 22, which is made of a wrapped material. The material can be partly adhesive on one or both sides. The package 20 is designed almost like a hose. FIG. 2B indicates that the package 20 is filled with fibres extending longitudinally in the package 20.

FIGS. 3A, 3B and 3C illustrates a second embodiment 30 of the package, which also is a continuous, tubular package 30 with a circular cross section 31 forming a cavity by an exterior wall 32. However, the exterior wall 32 is formed by two parts 33, which are firmly fixed together, e.g. by glue, at their longitudinal side edges forming protrusions 34. The protrusions 34 are symmetrical arranged at opposite sides exterior to the package 30 and are provided with holes 35 at uniform intervals along their lengths. FIG. 3B indicates that the package is filled with fibres extending longitudinally in the package 30.

A third embodiment of the package 40, see FIGS. 4A, 4B and 4C, is a continuous package 40 comprising one or more longitudinal trays 41 having a rectangular cross section 42 and a flat longitudinal lid 43 extending over all trays 41. The edges of the longitudinal sides of each tray form "wings" perpendicular to the sides 44 of the tray, which are sealed to the lid 43, e.g. by glue, adhesives or tape. The one or more trays are arranged side by side and are connected to each other by the lid 43. The "wings" of the sides 44 of one tray 41, if there is only a single one, or the outermost sides of two trays 41, if there are two or more trays 41, form protrusions 34 together with the side edges of the lid 43. Holes 35 are punched at uniform intervals in the protrusions 34. As indicated by FIG. 4B, the fibres are arranged transversally in the trays 41. In the case where there are more than one tray, the fibres can be of different types in different trays, for example the fibres can be of one length or/and thickness in a first tray and be of another in a second or third tray etc. Further, the fibres can be of different materials, e.g. in a first tray the fibres can be made of a polymeric material, in a second tray the fibres can be glassfibres, and in a third tray the fibres can be steel fibres.

Figures 5A, 5B, 5C:
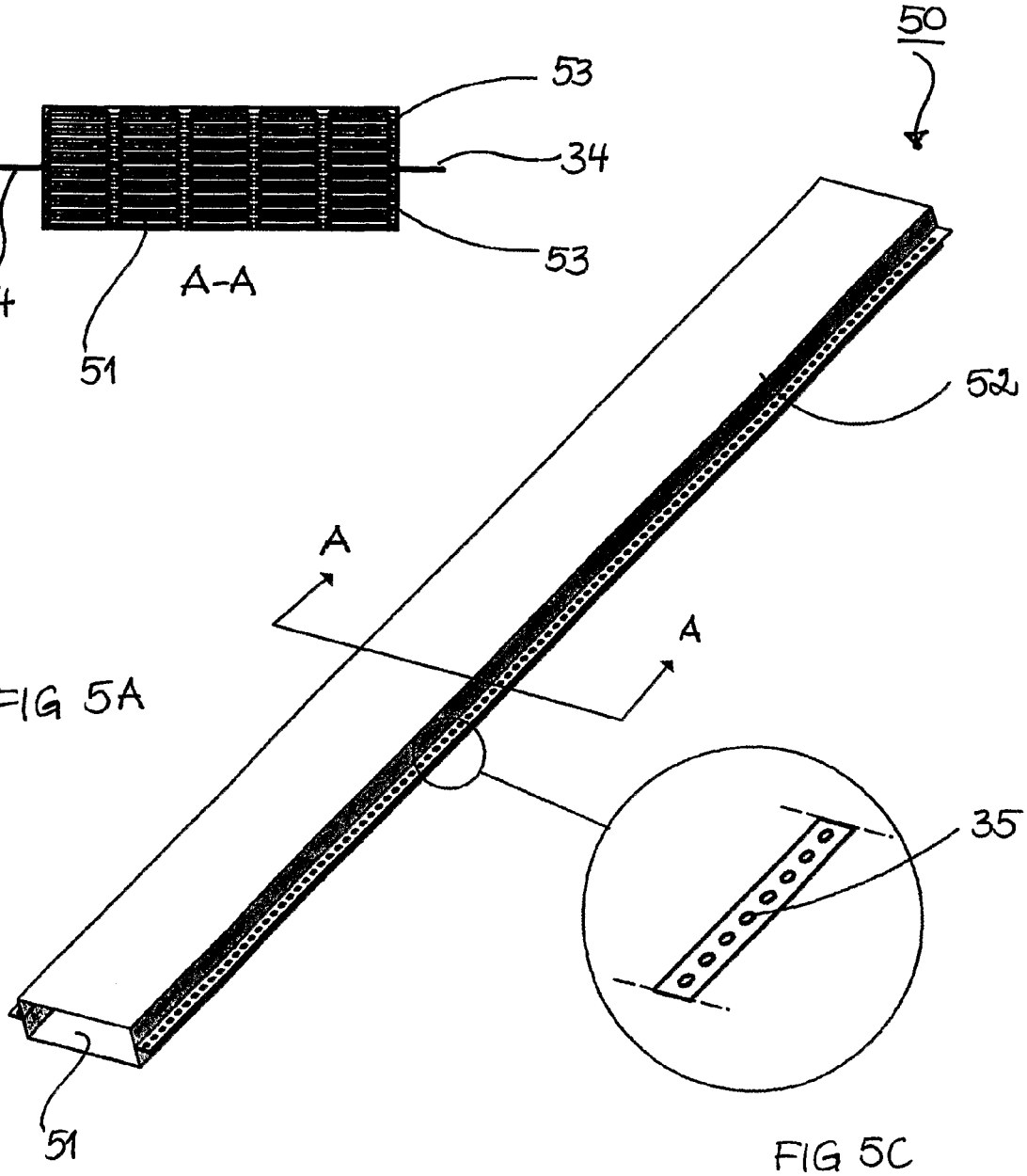
FIG. 5A is a schematic perspective view showing a package according to a fourth embodiment of the invention.
FIG. 5B is a cross sectional view of the package in FIG. 5A filled with fibres.
FIG. 5C is an enlarged view of the circled area in FIG. 5A, FIGS. 6A and 6B are schematic side views showing two ways of filling fibres into a package of the first embodiment according to the invention.

A fourth embodiment 50 of a package with reference to FIGS. 5A, 5B and 5C is a continuous longitudinal package having a rectangular cross section 51. The exterior wall 52, surrounding a longitudinal cavity, comprises two symmetrical parts 53, or trays 53, with "wings" at their side edges. The "wings" of one part 53 are firmly fixed to the "wings" of the other part 53 forming protrusions 34, which are symmetrical provided along the exterior of the package 50. Holes 35 are arranged at uniform intervals in the protrusions 34.

With reference to FIG. 5B, it is indicated that the fibres extending transversally are arranged in several bundles across the width of the package 50. The number of bundles may vary, and depends on the width of the package and the length of the fibres.

The protrusions 34 according to the second, third and fourth embodiments can be reinforced by plastic foil or strips to improve the stability and/or can be provided with holes 35.

The continuous packages 20, 30, 40, 50 according to the above described embodiments, irrespective of their shapes, can for example be made of plastic material or plastic coated paper material.

The cross section of a continuous package 20, 30, 40, 50 according to the first, second, third and fourth embodiment, respectively, could be of any arbitrary shape, e.g. circular, elliptical, square, rectangular, polygonal, etc.

As indicated above the fibres can be arranged transversally or longitudinally, but also randomly in the continuous package 20, 30, 40, 50. In the first case the fibres could be arranged in one row or in several rows side by side along the package 20, 30, 40, 50, and the fibres could be filled into the package 20, 30, 40, 50 as they are or in bundles, wherein the fibres may be stabilised by bundling means, such as tape, cord, wire, or similar means for improved and easy handling.

The fibres could be any type of fibres commonly used within the field of fibre concrete, such as steel fibres, glass fibres, carbon fibres, cellulose fibres but also synthetic fibres (e.g. made of polypropylene). The purpose of the fibres is to improve the properties of the curing material. The expression "fibre materials" is intended to include all curing materials provided with reinforcing fibres, such as concrete and mortar, also including fibre reinforced composite materials, such as plastic materials (PUR, PVC, PC, PA, PS, ABS, PE, PP, UP, etc.).

Figure 18:
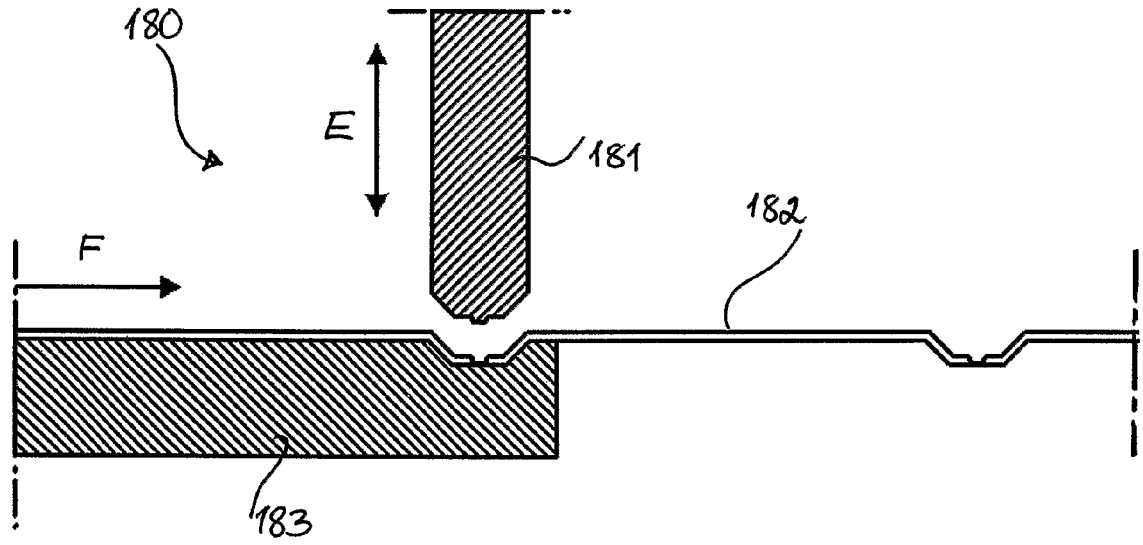
FIG. 18 is a schematic side view showing an arrangement for forming breakage or separation notches along a fiber.

The filling of fibres into the continuous package 20, 30, 40, 50 can be performed in connection with a production line for fibre manufacturing, which is well known per se. Alternatively the filling can be performed at another place, e.g. at a concrete plant far away from the fibre manufacturing. In the first case, the filling of fibres is performed in a machine following the step of cutting fibres in a cutting machine. In the latter case, the fibres are supplied from a bulk package, a big bag or a cartoon and should therefore be aligned, for example mechanically or by magnetic forces, before entering the continuous package 20, 30, 40, 50, to obtain a desired direction. It should be noted that the fibres can be cut into single, short fibres or be partly cut, i.e. they are still connected to each other like a chain but have breakage or separation notches (fractural impressions) along the chain. FIG. 18 illustrates an arrangement 180 comprising an upper part 181 acting on a fiber 182, which is supported by a lower part 183, by a downward movement—indicated by arrow E—from a fixed position, hence forming such breakage or separation notches along the fibre, when feeded in the direction of arrow F.

To illustrate a method for filling fibres into a continuous package 20, 30, 40, 50 references is made to FIGS. 6A, 6B, 7A, 8A and 9A. In all cases according to those figures the fibres are supplied as an even flow from the cutting machine (not shown) or from the bulk package, and the fibres are moved forward with a controlled, preset speed to ensure that a certain amount of fibres 61, 71 is filled per length unit, e.g.

per meter, of the continuous package 20, 30, 40, 50. The arrow B shows the feeding direction of the package 20, 30, 40, 50 when filled with fibres.

In FIG. 6A, notched fibres 61 from the cutting machine are filled into the package 20 according to the first embodiment. The package 20 is in this case formed by a tape 62, which is unrolled from a roll 63 and wrapped around the fibres as they are moving forward in the direction indicated by the arrow B, e.g. by transport belts 64. The tape is partly adhesive on one side to obtain a sealed package 20. FIG. 6B shows the same method of filling; the only difference is that the fibres 61 are fed from a tray 65. If the fibres are supplied as a fibre chain with notches as described above, they may be broken apart into single fibres by slightly twisting the package 20 by twisting rotation means after the filling.

Figure 7A:
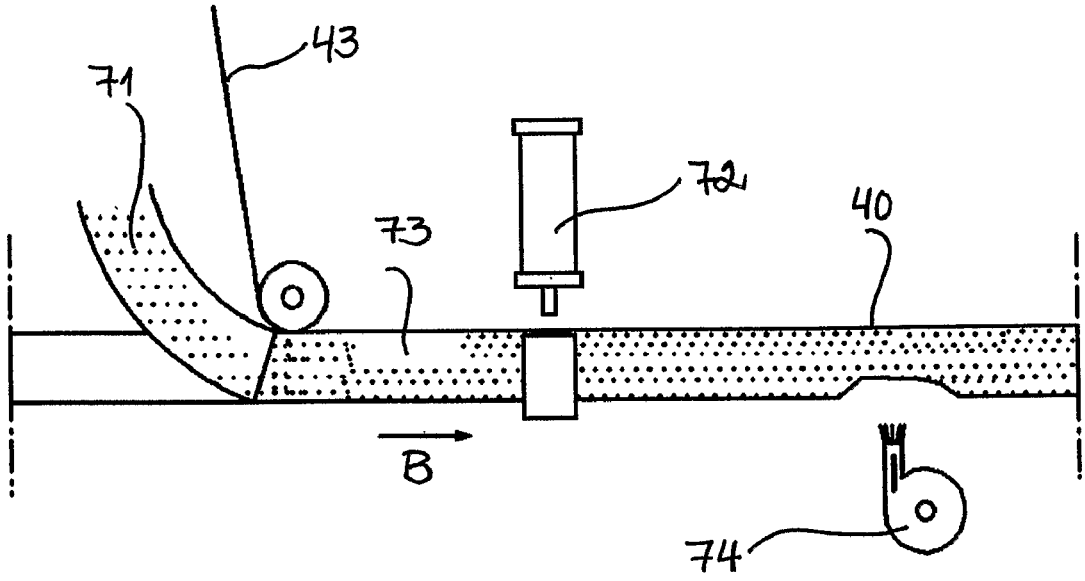
FIG. 7A is a schematic side view showing the filling of fibres into a package of the third embodiment according to the invention.
Figure 7B:
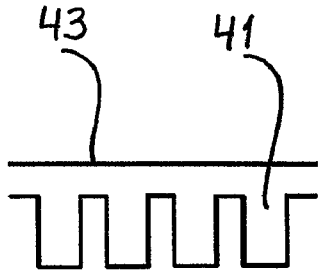
FIG. 7B is a cross sectional view of the package in FIG. 7A.

FIG. 7A shows a method for filling fibres into a package 40 according to the third embodiment. Fibres 71 are falling down into the package 40 comprising one or more trays 41, whereupon the lid 43 is supplied and firmly attached by glue or adhesive tape to the wings after the fibre filling. A punching device 72 provides holes 35 into the protrusions 34, which enables a safe regular movement of the package 40 by means of pin/tractor feeding.

Figure 8A:
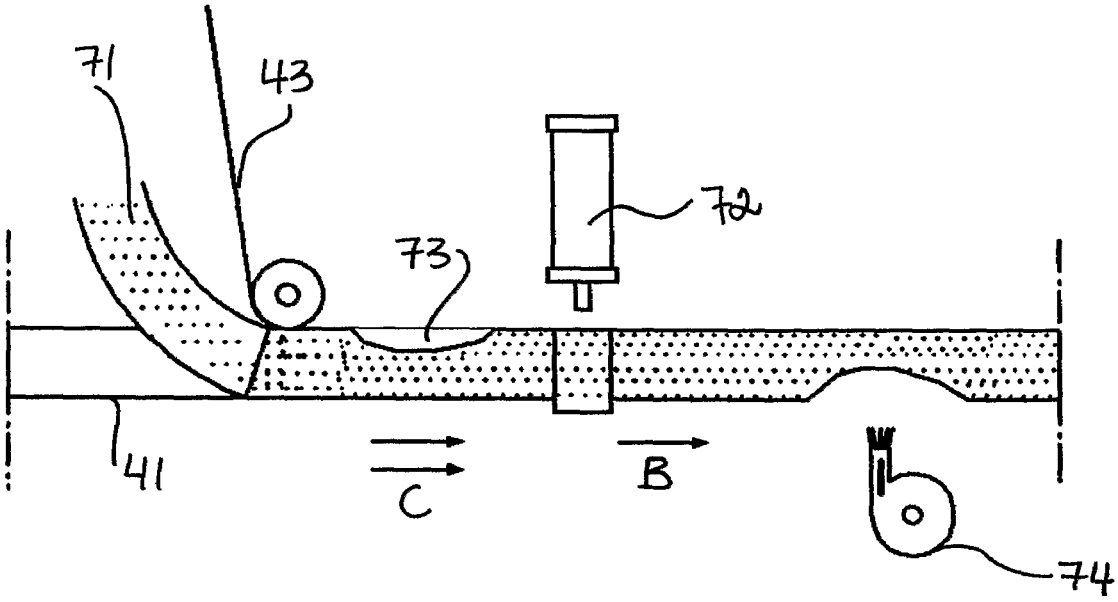
FIG. 8A is a schematic side view showing the filling of fibres into a package of the fourth embodiment according to the invention.
Figure 8B:
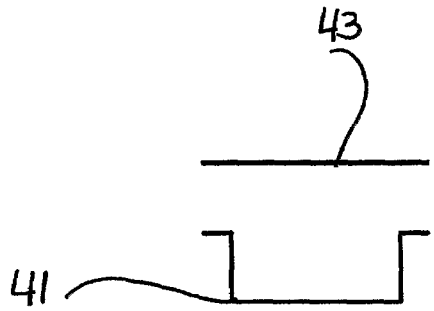
FIG. 8B is a cross sectional view of the package in FIG. 8A.

As indicated by 73, a short part of the package 40 can be filled with a less amount of fibres, e.g. obtained by decreasing the supply speed of fibres or increasing the belt speed at preset intervals, to enable the package 40 to be folded during transportation, see below. The package 40, filled with fibres, can be shrunk by exposure to hot air, for example from a fan 74, to keep the fibres 71 fixed in positions. FIG. 8A is similar to FIG. 7A showing the case with a package 40 comprising only one tray 41 and a lid 43. FIG. 8A clearly shows that the package 40 is filled with a less amount of fibres in a part 73 of the package 40, which can be the result when increasing the feeding speed of the package 41, 43, as indicated by arrows C. Parts 73 with a smaller amount of fibres facilitate the folding of the packages 20, 30, 40, 50 into the transport boxes 11.

Figure 9A:
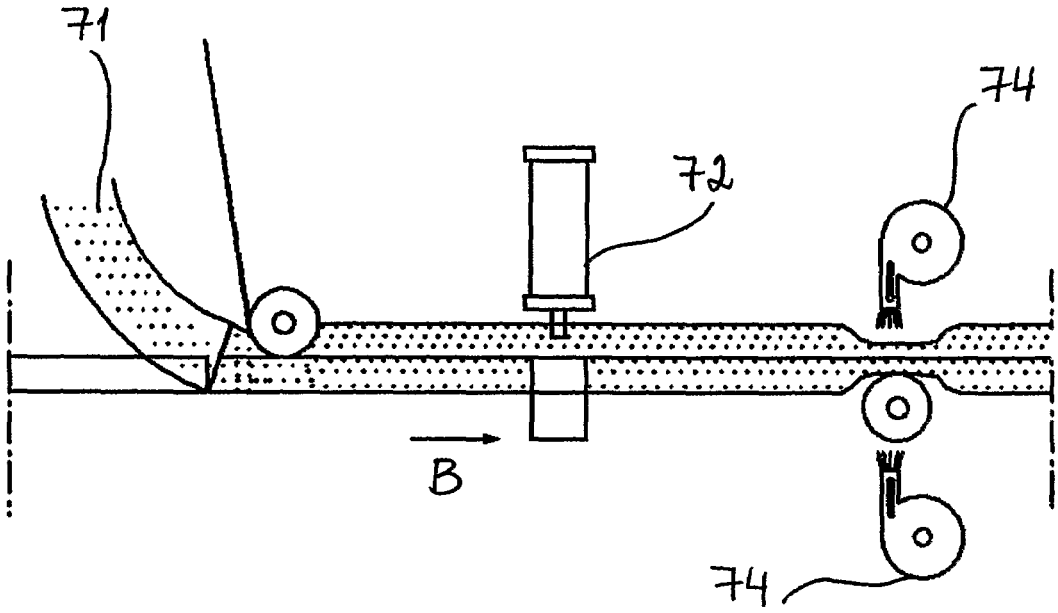
FIG. 9A is a schematic side view showing the filling of fibres into a package of the fourth embodiment according to the invention.
Figure 9B:
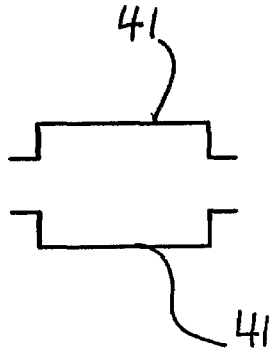
FIG. 9B is a cross sectional view of the package in FIG. 9A.

FIG. 9A illustrates essentially the same way of filling fibres into a package 20, 30, 40, 50 as in FIGS. 7A and 8A, but in this case the package comprises two identical parts, or trays 41, which are joined to each other forming an elongated package having a rectangular cross section. The fibres 71 are falling into the package when moving forward at controlled speed, and the trays 41 are firmly fixed to each other by e.g. glue or adhesive tape after filling. Two fans 74 may be used for shrinking the package 20, 30, 40, 50.

In the second, third and fourth embodiment, it is possible to assemble the integral parts of the package by glue, tape, zippers, snap fasteners, stitches, welding, etc.

Figure 10:
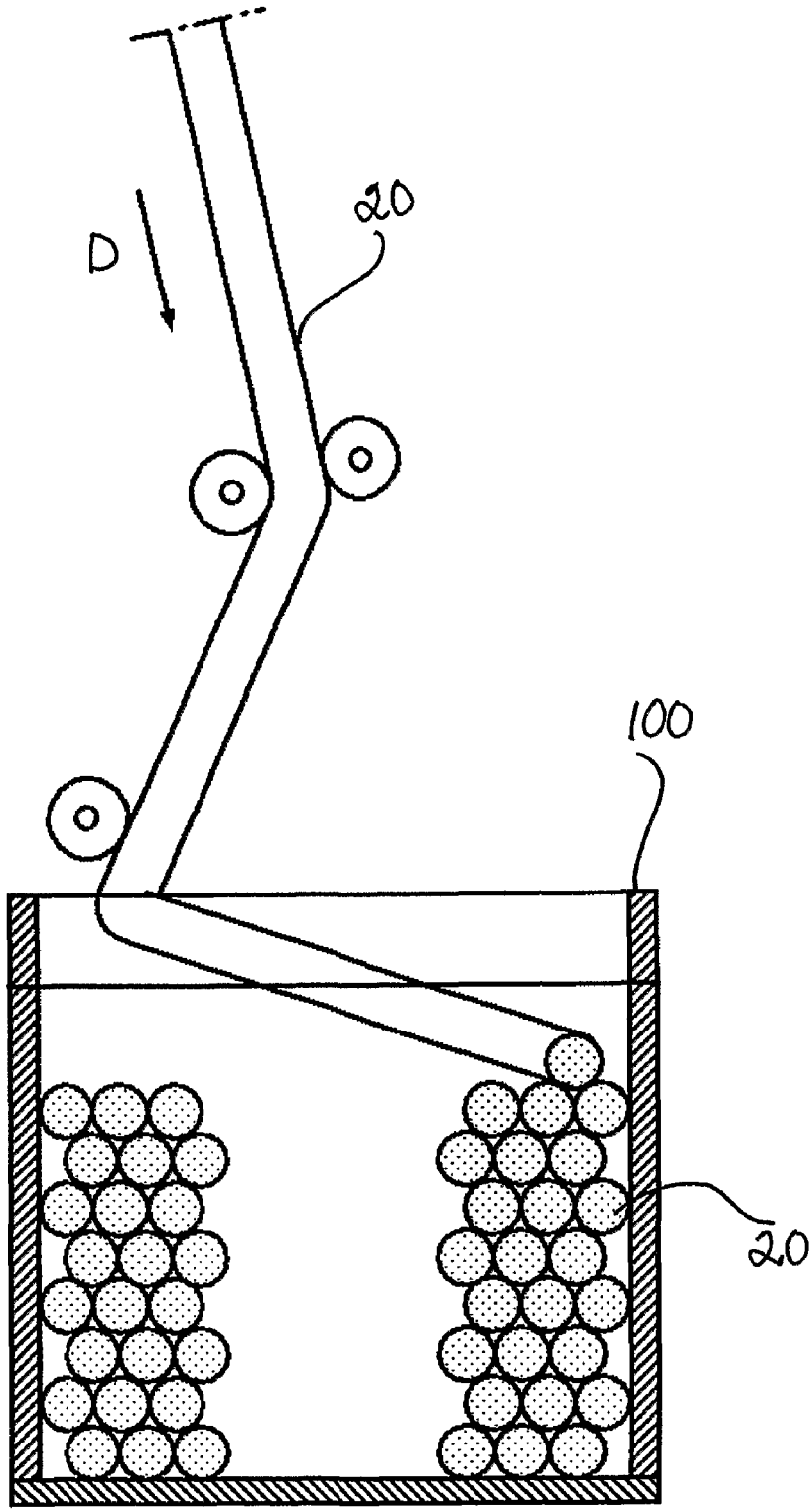
FIG. 10 is a schematic side view showing a first way of arranging a package according to the invention into a transport box.
Figure 11:
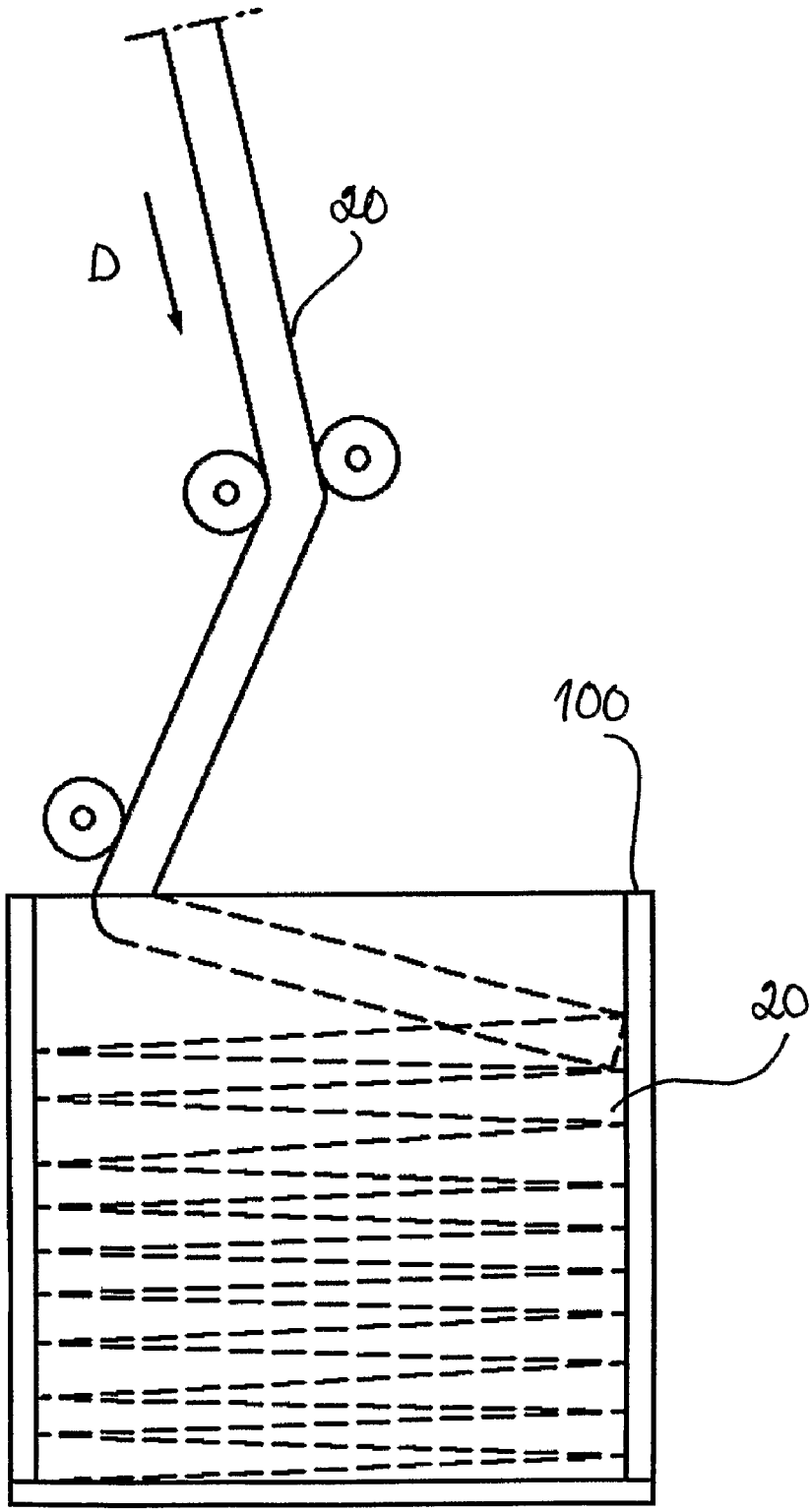
FIG. 11 is a schematic side view showing a second way of arranging a package according to the invention into a transport box.

The continuous package 20, 30, 40, 50 can be arranged into the transport box 11, for example in a carton 100 or a container, or on a pallet, for further transportation to the concrete plant. FIG. 10 illustrates the continuous package 20, 30, 40, 50 coming from the filling machine not shown, indicated by an arrow D, to be packed into the carton 100, wherein the package 20, 30, 40, 50 is winded either self-supporting or on a roll (not shown). FIG. 11 illustrates another way of arranging the continuous package 20, 30, 40, 50, i.e. folded into the carton 100.

The continuous package 20, 30, 40, 50 may be stored for a period of time at the concrete plant, since the transport box 11 or the continuous package 20, 30, 40, 50 itself protects the fibres from rainfall, snowfall, moist, pollution, etc., hence neither a shelter for the feeding machine or indoor storing of fibres may be required.

Figure 12:
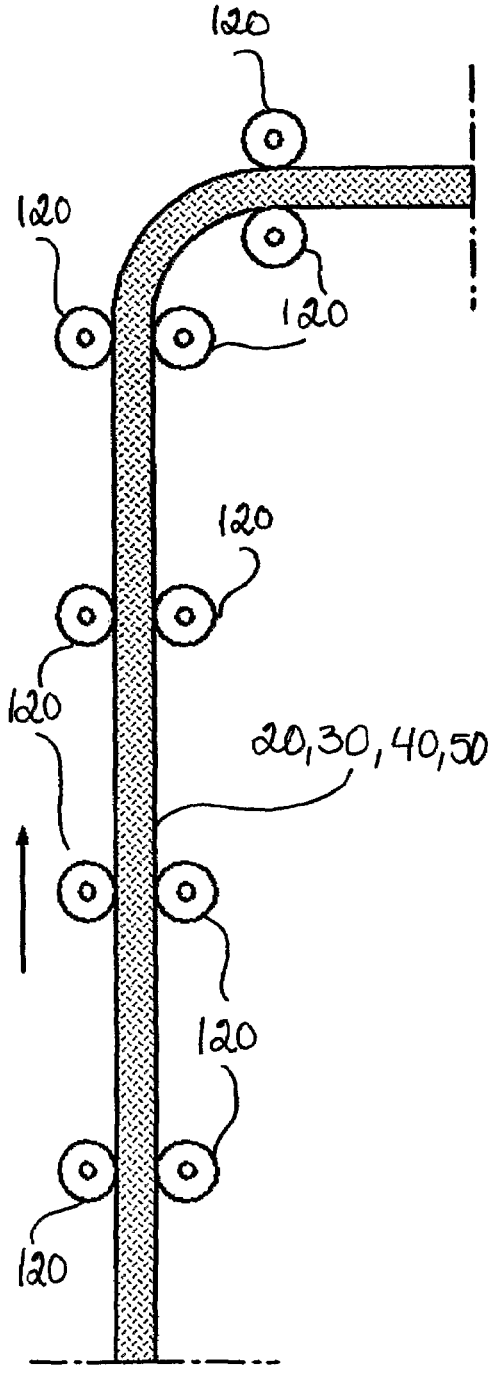
FIG. 12 is a schematic side view showing feeding means having friction rolls for transportation of a package according to the invention.
Figure 13:
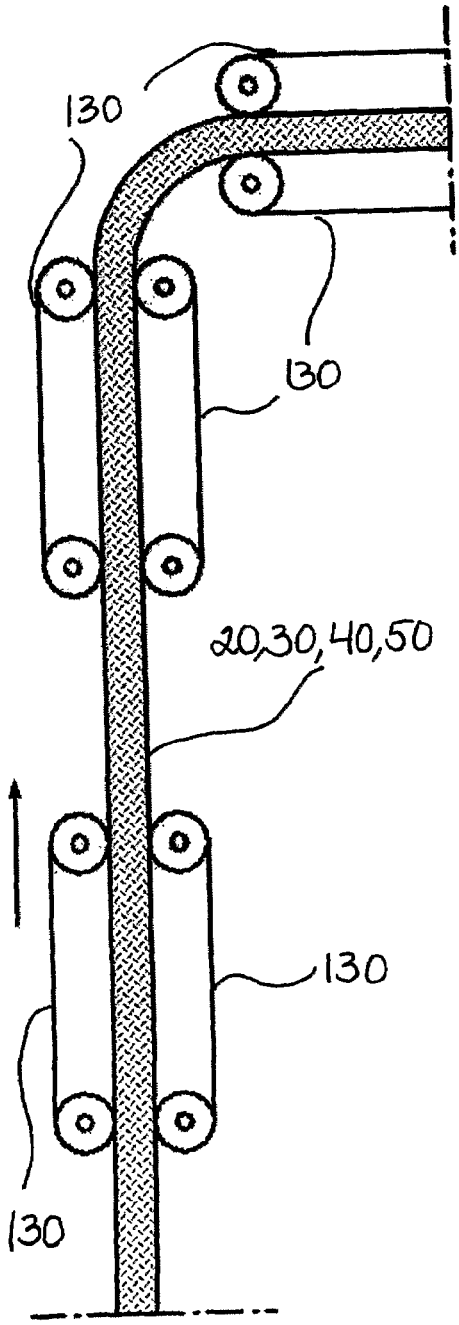
FIG. 13 is a schematic side view showing feeding means having friction belts for transportation of a package according to the invention.
Figure 14:
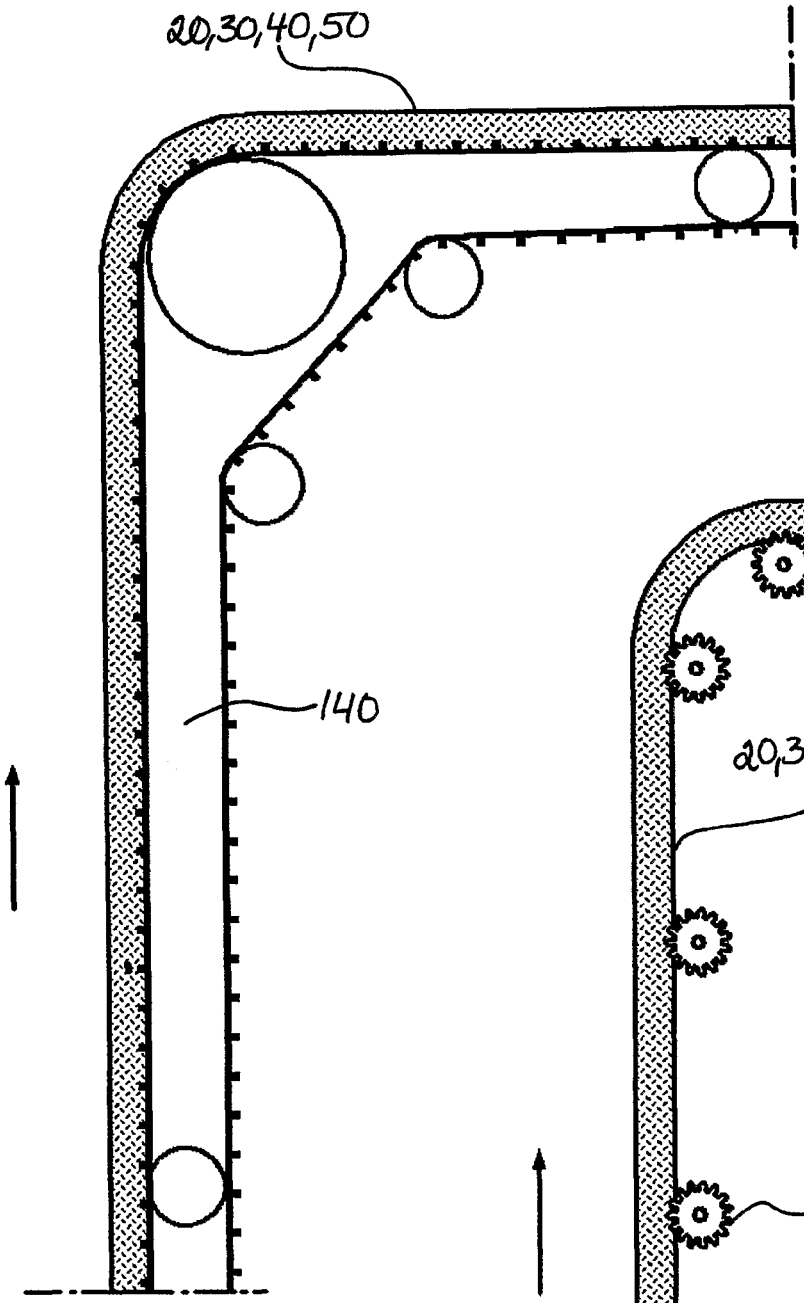
FIG. 14 is a schematic side view showing feeding means having a pin/tractor arrangement for transportation of a package according to the invention.
Figure 15:
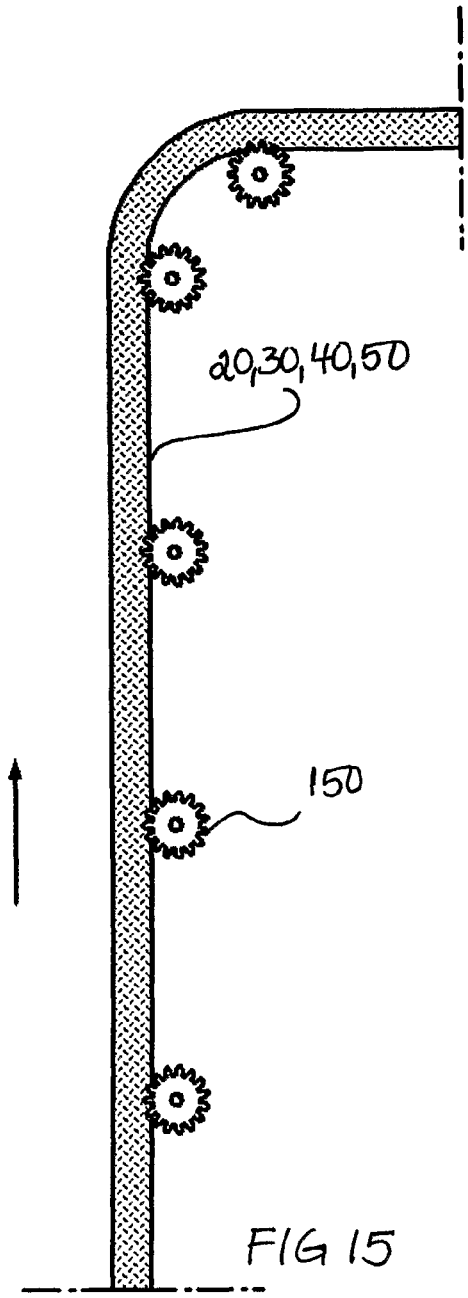
FIG. 15 is a schematic side view showing feeding means having pinwheels for transportation of a package according to the invention.

Due to the design and elongated shape of the continuous package 20, 30, 40, 50, there are many different ways of feeding the package 20, 30, 40, 50 from the filling machine to the transport box 11 and from the transport box 11 to a concrete mixer. By using friction rolls 120, as illustrated in FIG. 12, the package 20, 30, 40, 50 is simply and smoothly moved at a preset, controlled speed between the rolls 120. Another way is to use friction belts 130 as shown in FIG. 13. These both ways are especially well adapted for the inventive package according to the first embodiment. FIG. 14 shows yet another transportation means, a pin/tractor belt 140. With reference to the packages 30, 40, 50 according to the second, third and fourth embodiment, respectively shown in FIGS. 3, 4 and 5, the pin/tractor belt 140 is a convenient and reliable arrangement for the transportation. All packages according to the invention having protrusions provided with holes can be fed by means of any transport means comprising pins, cogs, teeth, or the like, such as conveyer belts, friction rolls or belts 130, pin/tractor means 140, chains with pins, apron feeders, and hence also pin wheels 150 can be used, as shown in FIG. 15.

Figure 16:
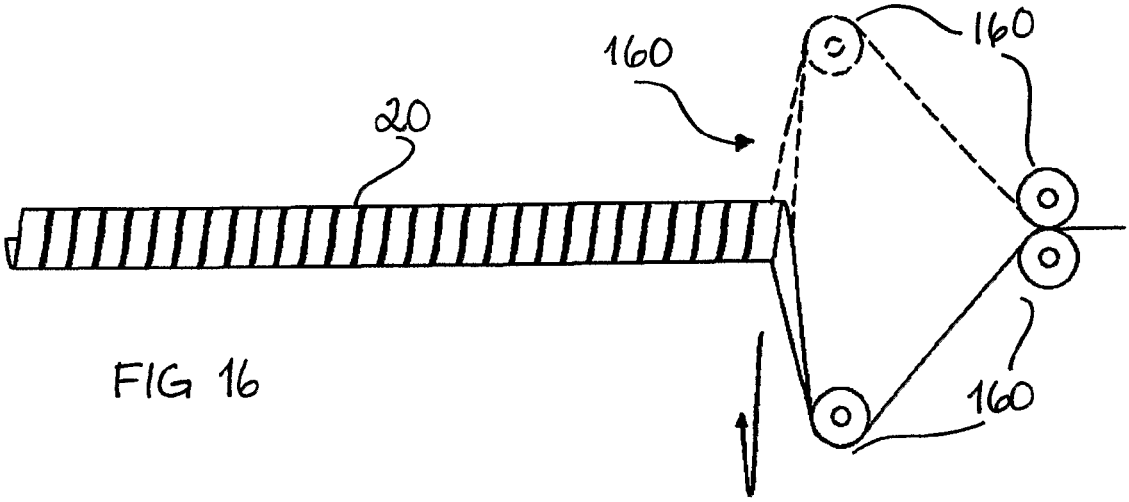
FIG. 16 is a schematic side view showing a step of a method according to the invention comprising opening a package according to the first embodiment by unwinding the package material and winding the package material on rolls.
Figure 17:
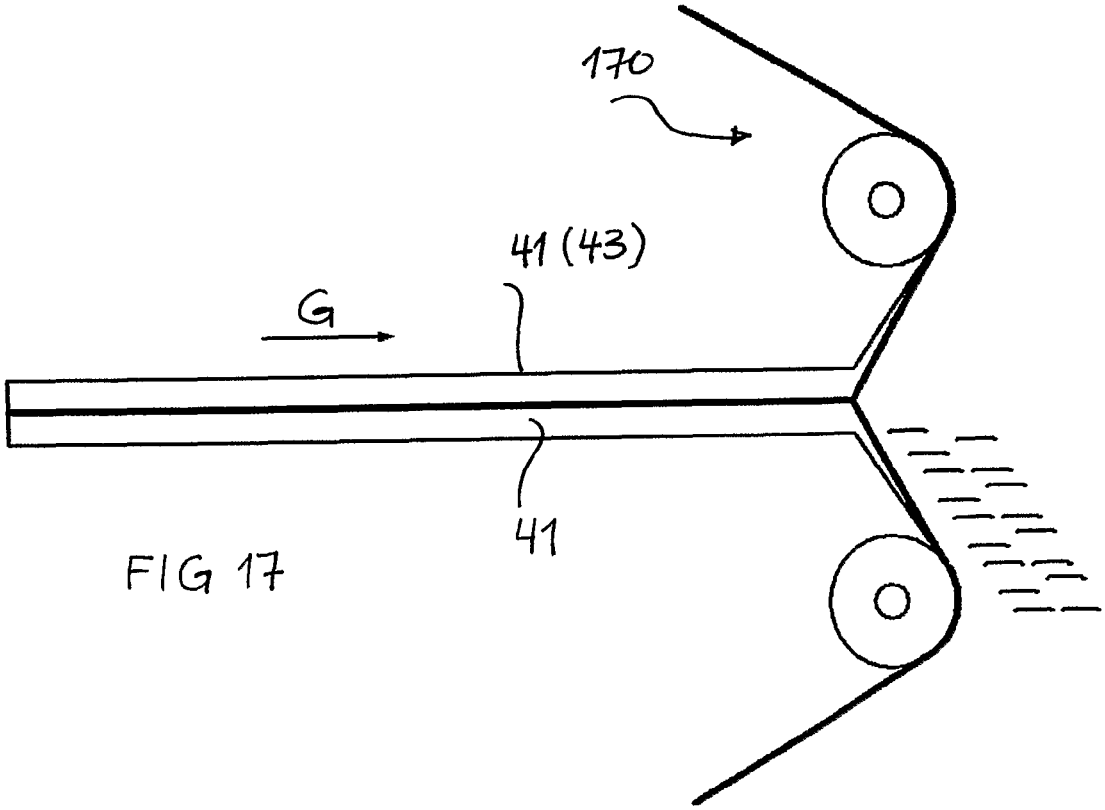
FIG. 17 is a schematic side view showing a step of the method according to the invention comprising opening a package according to the second, third and fourth embodiment by splitting open the package material and by winding the package material on rolls.

Above it is mentioned that the continuous package 20, 30, 40, 50 filled with fibres is opened and emptied at a high position 13. An arrangement 160 according to FIG. 16 can be used for taking care of the emptied package 20 made of wrapped tape according to the first embodiment, the tape being unwrapped by means of rolls 160 by applying forces larger than the adhesive forces of the tape. FIG. 17 shows an arrangement 170 for splitting open packages 30, 40, 50 according to the second, third and fourth embodiment, wherein forces larger than the adhesive forces of the tape or glue should be used to separate the tray(s) 41 from the lid 43 or from the second tray 41 in the case of a package comprising two trays 41. The arrow G indicates the forward movement of the package 30, 40, 50.

The method for filling and dosing reinforcing fibres into concrete according to the invention will now be described. The proportion between reinforcing fibres and the amount of concrete in the premixer 15 is important. By providing a continuous package 20, 30, 40, 50, which is filled with a predetermined amount of fibres per length unit, e.g. per meter, the supply of reinforcing fibres to the concrete can be well defined by the length of package provided.

The filling of fibres into the package 20, 30, 40, 50 are described above according to FIGS. 6A, 6B, 7A, 8A and 9A. The continuous package 20, 30, 40, 50 is filled with fibres forming an elongated hose with a length of up to e.g. 50 meters. The hose is arranged or packed into a transport box 11 and is transported by a vehicle, e.g. a truck, railway wagon or the like, to the concrete plant for direct use or for storing during a short or longer period of time.

In preparation for use the transport box 11 is brought close to the place where the continuous package 20, 30, 40, 50 should be used, e.g. near the premixer 15, and is opened at this place. Thereafter, one end of the continuous package 20, 30, 40, 50 is arranged into the feeding means 12 and the speed thereof is adjusted to feed the continuous package 20, 30, 40, 50 to supply a well defined amount of fibres per time unit to the concrete. Alternatively, a counter is provided and arranged to count the number of meters passing a start point, which is especially applicable when packages according to the second, third and fourth embodiments are used. In this case the number of holes 35 of the protrusions 34 passing the start point can be utilised to count the length of fibre filled package that is supplied e.g. to a truckmixer, the premixer 15, a transport or an aggregate belt, a weigh hopper or a skip. When the package 20, 30, 40, 50 has reached a high position 13 it is opened, the package material being collected in a groove 14, and is emptied from its content of fibres, which will fall down into the concrete.

An additional continuous package 20, 30, 40, 50 can be joined to the end of a previous package 20, 30, 40, 50 when the first one just has left its transport box 11, which offers a highly efficient production of fibre concrete without interruptions.

Although the present invention has been described above with reference to specific embodiments, it is not intended to be limited to the specific form set forth herein. Rather, the invention is limited only by the accompanying claims, and other embodiments than those specifically described above are equally possible within the scope of these appended claims.

In the claims, the term "comprises/comprising" does not exclude the presence of other elements or steps. Furthermore, although individually listed, a plurality of means, elements or method steps may be implemented. Additionally, although individual features may be included in different embodiments, these may possibly be combined in other ways, and the inclusion in different embodiments does not imply that a combination of features is not feasible. In addition, singular references do not exclude a plurality. The terms "a", "an" does not preclude a plurality. Reference signs in the claims are provided merely as a clarifying example and shall not be construed as limiting the scope of the claims in any way.

The invention claimed is:

1. A method for dosing fibres into concrete or similar materials, comprising:

providing an enclosed elongated package;

filling the elongated package with fibres via a filling machine, wherein the amount of fibres per unit length of the elongated package is predetermined;

aligning the fibres with relation to each other when filled into the elongated package;

transporting the elongated package via a transport box;

feeding the elongated package from the transport box to a mixer;

opening the elongated package;

emptying the fibres into the mixer; and dosing a defined amount of fibres to the mixer by at least one of adjusting the speed of feeding the elongated package to the mixer or counting the number of length units of the elongated package passing a starting point.

2. A method according to claim 1, further comprising:

feeding the elongated package from the transport box to the mixer by a feeder, and opening the elongated package over an aggregate belt, a conveyer belt, a skip, a weigh hopper, a truckmixer or a premixer.

3. A method according to claim 1, wherein the feeding is performed by a feeder selected from the group comprising conveyer belts, friction rolls or belts, pin/tractor means, pin wheels, chains with pins, apron feeders, and combinations thereof.

4. A method according claim 1, further comprising at least one of winding the elongated package on rolls, or feeding the elongated package into disposal sacks, after opening the elongated package.

5. A method according to claim 1, further comprising joining an additional elongated package to a previous one to obtain a continuous process of dosing fibres into the concrete.

6. A method according to claim 1, wherein the elongated package is tubular.

7. A system for performing the method of claim 1, wherein the system comprises the elongated package filled with fibres, a feeder for feeding the elongated package to a high position, an opening device for opening the elongated package, and a groove for transporting the fibres to the material to be reinforced.

8. A system according to claim 7, wherein the system further comprises an additional feeder for feeding the elongated package into the transport box when the elongated package has been filled with fibres.

9. A system according to claim 7, wherein the system further comprises an aggregate belt, a weight belt, a truckmixer, a skip or a premixer.

* * * * *